US007302735B2

(12) United States Patent
Palmer

(10) Patent No.: US 7,302,735 B2
(45) Date of Patent: Dec. 4, 2007

(54) BAG HANDLE

(76) Inventor: Robert Palmer, 11825 E. 168th St., Artesia, CA (US) 90701

( * ) Notice: Subject to any disclaimer, the term of this patent is extended or adjusted under 35 U.S.C. 154(b) by 295 days.

(21) Appl. No.: 11/221,993

(22) Filed: Sep. 8, 2005

(65) Prior Publication Data

US 2007/0050948 A1 Mar. 8, 2007

(51) Int. Cl.
*B25G 3/32* (2006.01)

(52) U.S. Cl. ..... 16/422; 16/411; 16/428

(58) Field of Classification Search ..... 16/114.1, 16/422, 425, 428 X, 436, 411 X; 383/13, 383/6, 24–25; 294/137, 143, 153, 158–159, 294/162, 165–166, 170; 24/373, 374, 588.1, 24/588.11, 594.1, 596.1, 599.5, 599.4; D9/455, D9/434

See application file for complete search history.

(56) References Cited

U.S. PATENT DOCUMENTS 257,721 A * 5/1882 Kempshall ..... 24/374
1,572,006 A 2/1926 Griffin
3,582,124 A * 6/1971 Quirk, Jr. ..... 294/26
4,472,902 A * 9/1984 Fraser ..... 43/43.11
4,561,577 A * 12/1985 Moore ..... 224/232
4,791,702 A 12/1988 McVey
4,841,596 A 6/1989 Fink
5,368,393 A 11/1994 Normann
5,433,494 A 7/1995 DuBuisson
5,667,266 A 9/1997 Giocanti
5,992,803 A 11/1999 LeRoux
D442,487 S 5/2001 Pruitt et al.
6,499,781 B1 12/2002 Flynn
6,584,642 B2 * 7/2003 Hodson ..... 16/85

* cited by examiner

*Primary Examiner*—Chuck Y. Mah
(74) *Attorney, Agent, or Firm*—Quick Patents, Inc.; Kevin Prince

(57) ABSTRACT

A bag handle is disclosed that includes a rigid, elongated body having an upwardly facing top surface, a downwardly facing lower surface, opposing front and back surfaces, and a pair of opposing side surfaces. A pair of hooks extend at each side surface outwardly therefrom proximate the lower surface of the body and generally parallel to each side surface. Preferably each hook extends above the top surface and terminates in a radiused point. A pair of biased locking means each comprise a biasing means, such as a coiled metal spring, and a hook engagement member, such as a glass marble. The hook engagement member protrudes from one side surface and is urged to contact one of the hooks by the biasing means. A method of use is disclosed for selectively engaging and disengaging a plurality of plastic grocery bags with the hooks and the hook engagement means.

12 Claims, 1 Drawing Sheet

BAG HANDLE

FIELD OF THE INVENTION

This invention relates to handles, and more particularly to a handle for plastic grocery bags.

DISCUSSION OF RELATED ART

A wide variety of handles exist for assisting in the carrying and transport of plastic grocery and other looped bags. While each bag, by itself, is relatively easy to carry by holding onto a loop of the bag, or a twine bag handle or the like, carrying multiple bags can be difficult and even painful for the average shopper, depending upon the number of bags the shopper carries and the weight of the items in each bag. As a result, auxiliary handle devices have been created to assist the user in carrying more bags than he otherwise would be able to.

For example, U.S. Pat. No. 4,791,702 to McVey on Dec. 20, 1988, discloses a generally elongated handle with two loops of rope for securing through the loops in a plurality of bags. Such a device, however, is inconvenient to use since the user must thread the rope through the loops in the bags and then, when desiring to release the bags the user must then disengage the rope from the handle and pull the rope through the loops. This process is typically a two-handed operation.

Further, such a device teaches a scalloped handle which, while perhaps benefiting users with a particular hand size, tends to aggravate users with hand sizes wherein the scalloped points dig into the user's natural figure positions. Accordingly, such scalloped handles tend not to be universal in aiding the user's grip on the handle. While these drawbacks seriously hinder the effectiveness of such a device, a benefit of this device is that while the bags are located, for example, in a trunk of an automobile and the bags are engaged with such a device, the bags will tend to remain closed and will be constrained in their movement so as not to become disengaged with the handle. As such, the contents of such bags are retained in the bags during transport.

U.S. Design Pat. D442,487 to Pruitt et al. on May 22, 2001 does not have this aforesaid advantage, as during transport any bags engaged to such a device may be quickly disengaged. Consequently, bags held by such a device during transport may become opened and unrestrained, the contents therein having an increased chance of being emptied from the bags due to movements during transport thereof.

Another handle device is taught in U.S. Pat. No. 1,572,006 to Griffin on Feb. 9, 1926. Such a device teaches a handle with a pair of hooks on either end that are adapted for engaging a stringed loop of a box or other package. While such a device could be adapted for use with common plastic grocery bags, such a device does not allow for many bags to be placed on the hooks thereof due to size constraints thereof, at least as illustrated. Further, to disengage such a device from the bags upon reaching a destination for the bags the user must use two hands to both hold the handle and flip-up a locking tab of such a device. Such a device cannot easily be inverted to disengage the bags, moreover, since three hands would be required, one to hold the handle and one each to hold back the locking tab on each side of the device. It is assumed that most user's would not be able to flip back the locking tabs with one hand, but even if the device was designed to allow such the removal of the bags would be inconvenient.

U.S. Pat. No. 5,368,393 to Normann on Nov. 29, 1994, and U.S. Pat. No. 5,992,803 ot LeRoux on Nov. 30, 1999, both teach a bag handle device that maintains the bags when engaged with the handles of such devices generally proximate to the longitudinal axes of such devices. As such, to disengage the bags from such devices, the user may rotate the handle 180 degrees along its longitudinal axis. The —393 device has the drawback that the bags are not completely retained on the handle of such a device, and as such may easily become disengaged during transport. The —803 device has a similar drawback, with the added drawback that the bags will likely get caught on the various hooks at each end of such a device when the handle is rotated to disengage the bag. As plastic bags are susceptible to easy puncturing by plastic hooks and the like, the —803 device has considerable drawbacks in this regard and disengaging a plurality of bags from such a device would be considerably inconvenient and, most likely, a two-handed operation.

U.S. Pat. No. 4,841,596 to Fink on Jun. 27, 1989 teaches another bag carrying handle in which bags are captured by to hook-shaped sides. However, bags held by such a device may easily become dislodged from the handle during transport, since the hooks are not actively closed or urged completely shut. A gap is taught in such a device, a gap through which a bag may be inadvertently released. A further drawback to such a device is the shape of the lower surface thereof, a shape that does not promote balanced handling of the handle, and which is not comfortable for most people to grasp, particularly while carrying a significant weight of bagged items.

U.S. Pat. No. 6,499,781 to Flynn on Dec. 31, 2002 teaches a handle device adapted for carrying a load of bags by hand or suspended on one's shoulder or forearm. The resiliency of the plastic material from which such a device is made determines the force with which the hook sections of such a device remain closed. Over time, plastic materials, particularly when subjected to heat in parked automobiles (where such devices are typically stored) break down and become more pliable. Further, the hooks of such devices when frequently subjected to the weight of multiple, packed grocery bags tend to deform over time. As a result, bags are able to more easily become disengaged with such a device, over time, during transport, as the hook sections become more flexible due to heat and use loads.

U.S. Pat. No. 5,667,266 to Giocanti on Sep. 16, 1997 has similar drawbacks, with the further drawback that the users fingers can easily be pinched between the abutment of such a device a top arm of such a device when a load is applied, such as when lifting. The concave lower arm of such a device, while adapted for resting on a shoulder or forearm of the user, makes a fairly uncomfortable handle for holding by the hand, due to its non-rounded downward facing surface.

U.S. Pat. No. 5,433,494 to Du Buisson on Jul. 18, 1995, teaches a device that overcomes most of the aforementioned problems, but yet has drawbacks of its own. Principally, such a device may not be easily used with one hand, as a user must manually slide an actuation means against a spring force to disengage a closure pin a hook on either side of the body of such a device. While this is easy enough to do with one's thumb on one side of the body, the device must be turned around, or the user must let go of the device and grasp the device in the other direction, in order to actuate the actuation means on the other side of the body of such a device. This action is inconvenient to the user, particularly when the user is holding car keys, an infant, or some other object in one's other hand. A further drawback of such a device is the indentations for the user's fingers in a downward facing bottom surface of such a device. While such indentations may be spaced conveniently and comfortably for some users, other users with either smaller or larger hands than average will find such indentations uncomfortable, causing their fingers to become either uncomfortably spaced apart or set at different heights relative to one another.

Clearly, then, there is a need for a bag handle wherein multiple bags may be quickly engaged with the handle with one hand and without the need to slide any actuators or otherwise use another hand, or let go with one hand in order to grip the handle in the opposite direction, in order to effectively engage the bags to the handles. Such a needed device would allow the user to insert the handle into a loop of the bag without requiring much precision, whereby thereafter the bag would slide down the length of the handle to become engaged with a hook on either end of the handle. The needed device would further allow the selective positive engagement of a bag to the handle with a consistent engagement force, such engagement force not varying over time as the plastic materials of such a device wear out. The needed device would allow the handle to be rotated along its longitudinal axis in order to easily release the bags therefrom. Further, the needed device would be made from readily available items of manufacture, and would be easily customizable for specific customers or users. The needed device would have an attractive and distinct appearance and would provide positive audible feedback to the user when a bag was either engaged or disengaged properly from the device. The present invention accomplishes these objectives.

SUMMARY OF THE INVENTION

The present device is a bag handle that includes a rigid, elongated body having an upwardly facing top surface, a downwardly facing lower surface, opposing front and back surfaces, and a pair of opposing side surfaces. A pair of hooks extend at each side surface outwardly therefrom proximate the lower surface of the body and generally parallel to each side surface. Preferably each hook extends above the top surface and terminates in a radiused point.

A pair of biased locking means each comprise a biasing means, such as a coiled metal spring, and a hook engagement member, such as a glass marble. The hook engagement member protrudes from one side surface and is urged to contact one of the hooks by the biasing means.

The present invention is a bag handle wherein multiple bags may be quickly engaged with the handle with one hand and without the need to slide any actuators, use another hand, or let go with one hand in order to grip the handle in the opposite direction, in order to effectively engage the bags to the handles. The present device allows the user to insert the handle into a loop of the bag without requiring much precision, whereby thereafter the bag may slide down the length of the handle to become engaged with a hook on either side of the handle. Further, the present invention allows the selective positive engagement of a bag to the handle with a consistent engagement force, such engagement force not varying over time as the plastic materials of such a device become worn. The present invention allows the handle to be rotated along its longitudinal axis in order to easily release the bags therefrom. Further, the present device is made from readily available items of manufacture, thereby reducing manufacturing costs, and is easily customizable with an indicia in the top surface thereof for specific customers or users. The present device has an attractive and distinct appearance and further provides positive audible feedback to the user when a bag is either engaged or disengaged properly from the device. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
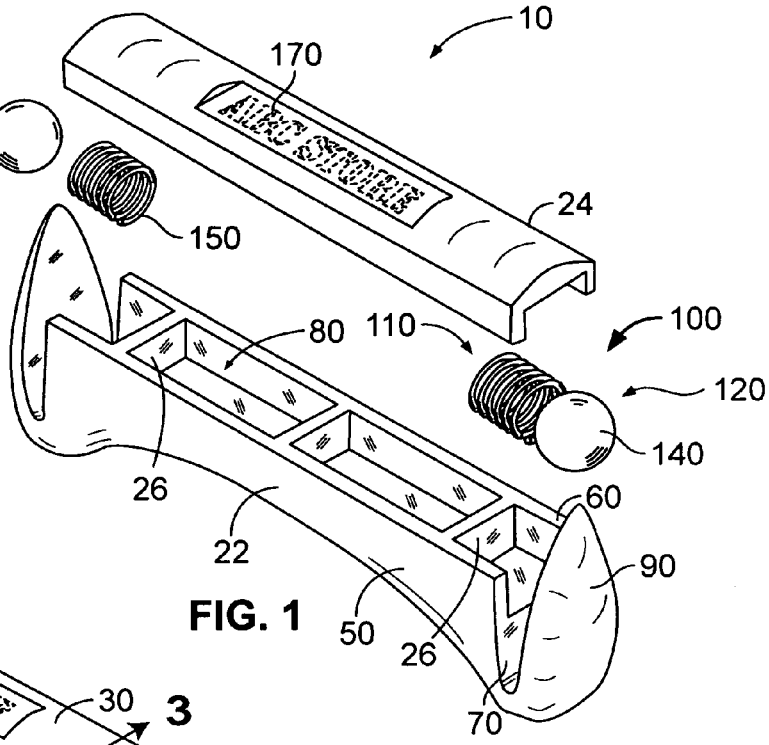
FIG. 1 is an exploded perspective view of the invention.
Figure 2:
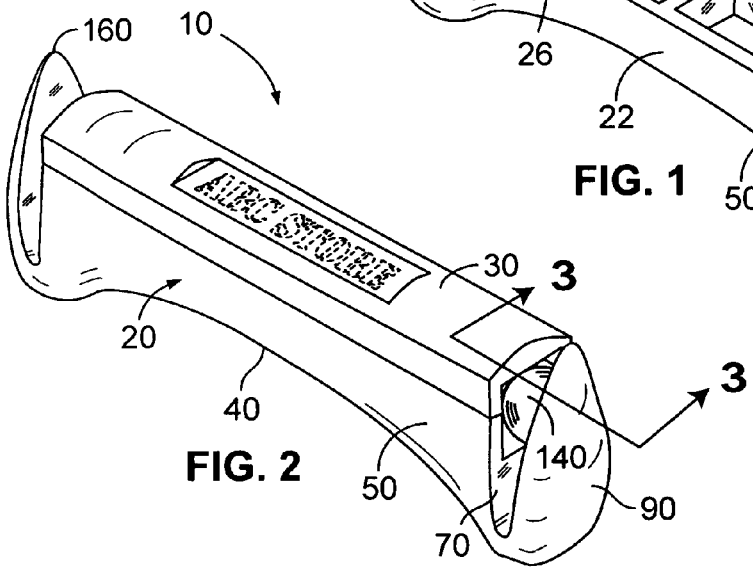
FIG. 2 is a perspective view of the invention, illustrating a pair of hooks on opposing sides of an elongated body and a coil spring urging a marble into a side of each hook.

FIGS. 1 and 2 illustrate a bag handle 10 that includes a rigid, elongated body 20 having an upwardly facing top surface 30, a downwardly facing lower surface 40, opposing front surface 50 and back surface 60, and a pair of opposing side surfaces 70, a volume 80 being defined therewithin. The body 10 preferably comprises a bottom piece 22 and a top piece 24, the combination of which fit together to form the common front surface 50, back surface 60, and side surfaces 70. The bottom and top pieces 22,24 are each preferably a strong, molded plastic material, such as ABS or PVC, or the like.

The top surface 30 of the top piece 24 preferably further includes an indicia area 170. Such an indicia area 170 may be formed with a temporary mold plate that is interchangeable to allow various alternate indicia to be formed into the top piece 24. For example, store brand names or logos may be incorporated into the indicia for allowing private labeling of the bag handle 10.

In the preferred embodiment of the invention, the bottom surface 40 is rounded from the back surface 60 to the front surface 50 in a generally constant concave arc facing upward towards the top surface 30. Such a rounded bottom surface 40 provides a comfortable grip to those carrying multiple bags 130 (FIG. 4) with the bag handle 10. Further, the bottom surface 40 is bowed slightly concave down between each side surface 70, thereby providing a balance point central to the body 20 for a person carrying multiple bags 130 and further increasing comfort for the user.

Figure 3:
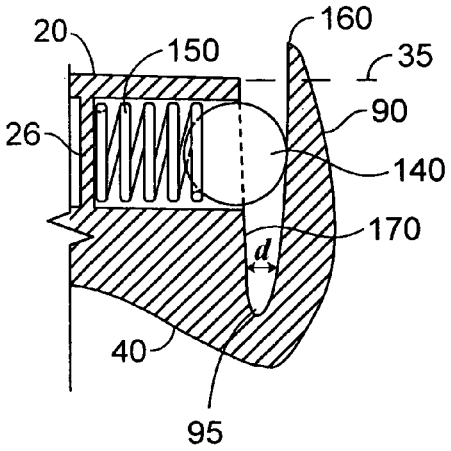
FIG. 3 is a partial cross-sectional view of the invention, taken generally along lines 3-3 of FIG. 2, and further illustrating the coil spring and marble of the invention; and, FIG. 4 is a partial side elevational view of one side of the invention, illustrating bag handles passing by the marble to be temporarily captured between the hook and the marble.

A pair of hooks 90 are included with the body 20, the hooks 90 extending at each side surface 70 outwardly therefrom proximate the lower surface 40 of the body 20 a distance d (FIG. 3) generally parallel to each side surface 70. Preferably each hook extends above a top-most tangential plane 35 of the top surface 30 and terminates in a radiused point 160. As such, the hooks 90 may be molded as part of the bottom piece 22, such that a bottom portion 95 of the hooks 90, which are subjected to the most weight strain when the bags 130 are lying therein, are formed integral with the supporting bottom piece 22, and as such are less likely to structurally fail. Preferably, the bottom piece 22 is made with a Delrin® brand of plastic material manufactured by DuPont, which is extremely strong and durable and in tests virtually indestructible.

The bag handle 10 further includes a pair of biased locking means 100, each comprising a biasing means 110, such as a coiled metal spring 150, and a hook engagement member 120, such as a glass marble 140 (FIGS. 1-4) or a metal ball bearing (not shown). The hook engagement member 120 protrudes from one side surface 70 and is urged to contact one of the hooks 90 by the biasing means 110. The biasing means 110 may, alternately, be a coiled plastic spring, a piece of elastomeric rubber or resilient foam (not shown), or any other commonly known biasing means used in the art. Further, the biased locking means 100 may be integrally formed with the biasing means 110 and the hook engagement member 120, such as unitarily molded or folded from flat sheet metal material (not shown). Preferably, however, the hook engagement member 120 is a separate component from the biasing means 110 so that the hook engagement member 120 may spin with respect to the biasing means 110 to facilitate travel of the bag 130 between the hook 90 and the hook engagement member 120. As such, the glass marble 140 provides a readily available, easy-to-fabricate hook engagement member 120 that additionally adds ornamental appeal to the bag handle 10 and a distinctive appearance.

The bottom and top pieces 22,24 of the body each preferably further include a spring backing plate 26, proximate the side surfaces 70 thereof. The spring backing plates 26 each rigidly resist the force of the biasing means 110 so that each biasing means 110 urges the hook engagement member 120 into one of the hooks 90.

Figure 4:
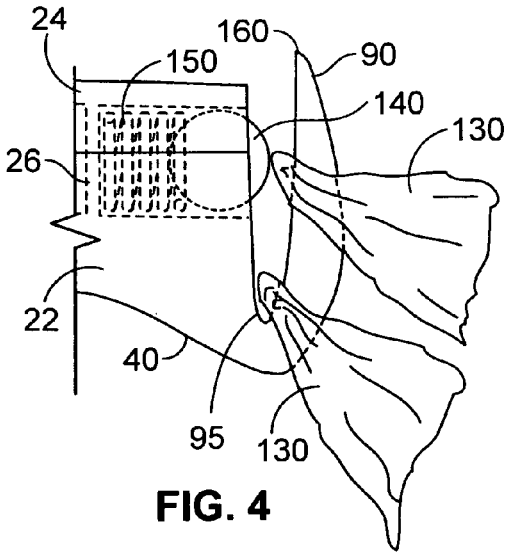

In use, while holding the bag handle 10 around the body 20, a user may insert one side 70 of the bag handle 10 through a loop in a bag 130 to be lifted, the bag 130 contacting the top surface 30 and then sliding towards the side surface 70 until the bag 130 falls between the hook 90 and the side surface 70. The bag 130 then contacts the glass marble 140, the weight of the bag 130 forcing the marble 140 into the volume 80 of the body 20 as the user lifts the bag handle 10 (FIG. 4). Once the bag 130 clears the marble 140, the spring 150 urges the marble 140 back into contact with the hook 90, typically with an audible "snap" sound to let the user know that the bag 130 is retained properly on the bag handle 10. Additional bags 130 may be likewise secured to the handle 10 on either side without the user needing to alter his hand position on the body 20. Preferably the bags 130 are generally evenly divided by two by either number or weight so that the distribution of weight on each side 70 of the handle 10 is balanced.

To disengage the bags 130 from the handle 10, the user places the bags 130 onto a surface, such as a kitchen floor or table surface (not shown), and either pulls the bags 130 past the marble 140 and free from the handle 10, or rotates the entire body 20 of the handle 10 along its longitudinal axis such that the hooks 90 face generally downward, whereupon when lifting the handle 10 the weight of each bag 130 naturally depresses the marble 140 inwardly, thereby releasing the bag 130 from the handle 10.

While a particular form of the invention has been illustrated and described, it will be apparent that various modifications can be made without departing from the spirit and scope of the invention. For instance, various hook engagement members 120 may be used, such as marbles, ball bearings, wooden spheres, and the like. Accordingly, it is not intended that the invention be limited, except as by the appended claims.

What is claimed is:

1. A bag handle, comprising:

a rigid, elongated body having an upwardly facing top surface, a downardly facing lower surface, opposing front and back surfaces, and a pair of opposing side surfaces, a volume being defined therewithin;

a pair of hooks extending at each side surface outwardly therefrom proximate the lower surface of the body a distance d and then upwardly therefrom generally parallel to each side surface; and a pair of biased locking means each comprising a biasing means and a hook engagement member, each said hook engagement member protruding from one respective side surface and contacting one of the hooks, the biasing means urging the hook engagement member to contact said hook, whereby a bag handle can be looped around one of the hooks such that it contacts and presses the hook engagement member inward, passing the hook engagement member, the hook engagement member resuming contact with the hook to retain the bag handle.

2. The bag handle of claim 1 wherein the hook engagement means is a glass marble.

3. The bag handle of claim 1 wherein the hook engagement means is a metal ball bearing.

4. The bag handle of claim 1 wherein the biasing means is a coiled metal spring.

5. The bag handle of claim 1 wherein the biasing means is a piece of elastomeric rubber.

6. The bag handle of claim 1 wherein the biasing means is a piece of resilient foam.

7. The bag handle of claim 1 wherein each hook extends above a top-most tangential plane of the top surface of the body and terminates in a radiused point.

8. The bag handle of claim 1 wherein the body comprises a bottom piece and a top piece, the bottom and top pieces fitting together to form the common front, back and side surfaces.

9. The bag handle of claim 8 wherein the top and bottom pieces each include spring backing plates proximate each side surface, whereby each spring backing plate rigidly resists the force of the biasing means so that the biasing means urges the hook engagement member into the hook.

10. The bag handle of claim 1 wherein the top surface further includes an indicia area.

11. The bag handle of claim 1 wherein the bottom surface of the body is rounded from the back to the front surfaces and bowed slightly concave down between each of the side surfaces.

12. A method of carrying a plurality of bags from one location to another location, comprising the steps of:

a) providing a bag handle as recited in claim 1;

b) holding the bag handle with the hooks facing generally upwardly;

c) engaging a bag with one of the hooks;

d) pulling up on the handle until the bag forces the hook engagement member away from the hook to capture the bag between a side surface of the body and the hook;

e) repeating steps c) and d) until all of the plurality of bags are engaged with the handle;

f) transporting the bags by lifting the handle from the one location to the another location;

g) setting the bags down onto a surface;

h) rotating the handle along its longitudinal axis such that the hooks are facing generally downwardly;

i) pulling up on the handle to cause the weight of the bags to depress the hook engagement member to release the bags from the handle.

* * * * *